US005306365A

United States Patent [19]

Reighard

[11] Patent Number: 5,306,365

[45] Date of Patent: Apr. 26, 1994

[54] APPARATUS AND METHOD FOR TAPERED HEATING OF METAL BILLET

[75] Inventor: Scott E. Reighard, Lower Burrell, Pa.

[73] Assignee: Aluminum Company of America, Pittsburgh, Pa.

[21] Appl. No.: 978,801

[22] Filed: Nov. 19, 1992

[51] Int. Cl.[5] ..... C22F 1/04; C21D 11/00

[52] U.S. Cl. ..... 148/688; 72/13; 72/342.5; 72/342.6; 72/342.94; 72/364; 148/511; 148/689; 266/80; 266/87; 266/259

[58] Field of Search ..... 148/688, 689, 511; 72/13, 342.5, 342.6, 342.94, 364; 266/80, 87, 259

[56] References Cited

U.S. PATENT DOCUMENTS

| | | | |
|---|---|---|---|
| 1,185,280 | 5/1916 | Beardsley | 148/687 |
| 1,595,123 | 8/1926 | Sheldon | 148/660 |
| 2,798,018 | 7/1957 | Derge | 148/641 |
| 3,615,923 | 10/1971 | Rum | 148/510 |
| 4,067,220 | 1/1978 | Hoffmann | 72/201 |
| 4,243,441 | 1/1981 | Wilson | 148/559 |
| 4,623,401 | 11/1986 | Derbyshire et al. | 148/559 |
| 4,724,014 | 2/1988 | Misawa et al. | 148/657 |
| 4,810,311 | 3/1989 | Economopoulos | 148/511 |
| 4,857,687 | 8/1989 | Andersson et al. | 219/10.57 |
| 4,913,747 | 4/1990 | Fukuda et al. | 148/508 |
| 5,027,634 | 7/1991 | Visser et al. | 72/342.5 |

OTHER PUBLICATIONS

Akeret, R.; Paul M. Stratman. "Unconventional Extrusion Processes for the Harder Aluminum Alloys, Part I", *Light Metal Age*, Apr. 1973, pp. 6–10.

Garner, O. G., *Aluminum Sheeting Press*, (General Cable Corporation, New York, N.Y., 1956) pp. 6, 9.

Hollingworth, P. E., "Induction Heating of Aluminum", *Aluminum Industry*, Aug./Sep. 1990, pp. 26–28.

Huchok, A. A., "New Developments in Induction Heat Treatment Processes", *Metals/Materials Technology Series*, American Society for Metals, Metals Park, Ohio, May, 1983, pp. 1–5.

Martin, D. H., "Mains Frequency Induction Heating for Non-Ferrous Extrusion", *Metallurgia & Metal Forming*, Sep. 1977, pp. 407–412.

Stott, J., "Induction Heating for Aluminum Extrusions", *Metallurgia and Metal Forming*, May, 1977, pp. 212–215.

Suhrer, James E., "Induction Heating of Non-Ferrous Billets", "Proceedings of Second International Aluminum Extrusion Technology Seminar, vol. I, Billet and Extrusion", Aluminum Association, Washington, D.C., 1977, pp. 179–181.

Takeuchi, K. Kambara, "Effect of Taper Heating in Extrusion", *Aluminum*, vol 60, 1984, pp. E472–E475.

Tseng, A. A.; J. J. Mills, S. H. Maslen, "Mathematical Model of Extrusion Preheater", *Materials Science and Technology*, Apr. 1988, pp. 361–364.

"Accuracy and Quality with Induction Billet Heating for Aluminum Extrusions", *Heat Treatment of Metals*, 1981, pp. 1–2.

*Primary Examiner*—Richard O. Dean

*Assistant Examiner*—Robert R. Koehler

*Attorney, Agent, or Firm*—Douglas G. Glantz; David W. Pearce-Smith

[57] ABSTRACT

Apparatus and process are disclosed for providing, and continuously monitoring and controlling, a tapered temperature profile in solid metal first heated to a specified initial temperature. Temperatures are monitored at a plurality of locations along the length of the metal and are adjusted by successively withdrawing and returning a portion to a heating source through physical movement In one aspect, apparatus and process continuously monitor and control a tapered temperature profile in a billet of aluminum alloy through a first step of rapid heating in a single-zone electric induction furnace to a temperature sufficient to bring the billet to its cold end set point while not exceeding its maximum skin temperature. The temperatures of the billet are monitored at its die end and its ram end and are adjusted by successively withdrawing and returning the billet to the induction furnace to reduce the heat in the ram end relative to the die end. A specified tapered temperature profile can be established and maintained along the billet to match a desired temperature profile reference value. In one aspect, the tapered temperature profile preferably produces a traveling crush or upset for reducing air entrapment in the billet to be extruded.

20 Claims, 2 Drawing Sheets

APPARATUS AND METHOD FOR TAPERED HEATING OF METAL BILLET

BACKGROUND OF THE INVENTION

1. Field of the Invention

This invention relates to means and method for providing a temperature profile in a billet of solid metal. In one aspect, the invention relates to apparatus and method for providing and continuously monitoring and controlling a tapered temperature profile in a billet of aluminum or aluminum alloy for the purpose of efficient forming by extrusion.

2. Background Information

Commercial production for forming aluminum by extrusion recognizes the advantages of induction heating. Induction heaters were first introduced into aluminum extrusion processes to speed up the heating cycle. The induction heater induces heating currents in the billet by a flux field generated around the induction coil. The coil of an electrical conductor is impressed with an alternating voltage to generate the electromagnetic flux field. When conductive billet material is placed inside the coil, eddy currents are generated within the billet and are converted into heat energy. Induction heaters provide advantages of minimum start-up time, fast heating, low maintenance cost, reduced manpower, smaller shop floor space, and increased operator comfort.

INTRODUCTION TO THE INVENTION

Production processes for forming aluminum by extrusion are largely dependent on the temperature of the billet of the aluminum or aluminum alloy. Whether the aluminum production is intended for forming rods, tubes, or shapes, aluminum extrusion processes require monitoring and controlling the temperature rise attributable to heat buildup in the metal from the shear stress associated with the extrusion.

Uniformly heated billets extruded by high speed by conventional presses are seen to have temperatures of the product emerging from the die equal to the billet temperatures only at the beginning of the extrusion process. As the extrusion process proceeds, temperatures rise by an amount proportional to the work done in the deformation zone of the metal being extruded. The temperature continues to rise as metal entering the deformation zone has a higher temperature because of shear stresses along the bore of the billet prior to extrusion through the die. The kinetic energy required in the extrusion converts to heat and flows into the billet, the die, and the billet container.

Reducing the temperature of the rear part of the billet permits higher extrusion speeds and lower extrusion pressures, because of a reduction in temperature of the billet. Aluminum production processes for extrusion forming can employ billets enhanced by tapering of the preheat temperature of the billet so that the die end is hotter than the ram end. The tapered preheat temperature can cause a traveling upset that reduces air entrapment in the aluminum product. However, conventional furnaces and processes used today are costly, difficult to set up for a new taper, and are poor at maintaining a taper during manufacturing delays.

Aluminum production forming by extrusion through conventional furnaces and processes used today have these certain drawbacks and inefficiencies, and apparatus and method are needed for increasing extrusion production rates without sacrificing quality of the extruded parts.

Efficient aluminum-forming production by extrusion also requires a more timely method for providing a specified temperature profile in the aluminum billet. Further, a temperature profile induced in one alloy may not correspond to the extent of the induced temperature profile in another alloy using the same heating time. Apparatus and method are needed to monitor and control the specified temperature profile of the aluminum billet in real time.

In accordance with the present invention and to overcome the drawbacks and inefficiencies of conventional furnaces and processes, apparatus and method have been developed for continuously monitoring and controlling the temperature profile in a billet of aluminum or aluminum alloy by a novel technique and with novel apparatus employing induction heating and temperature monitoring and control.

It is an object of the present invention to provide means and method for providing a tapered temperature profile in a billet of aluminum or aluminum alloy.

It is a further object of the present invention to provide means and method for monitoring and controlling a tapered temperature profile in a billet of aluminum or aluminum alloy.

It is yet another object of the present invention to provide means and method for monitoring and controlling a tapered temperature profile in a billet of aluminum or aluminum alloy prior to a precision forming process by extrusion.

It is still another object of the present invention to provide means and method for monitoring and controlling a tapered temperature profile in a billet of aluminum or aluminum alloy as part of an efficient production process for forming by extrusion.

It is a further object of the present invention to provide means and method for automating a sensor system for monitoring and controlling a tapered temperature profile in a billet of aluminum or aluminum alloy as part of an efficient production process for forming by extrusion.

These and other objects of the present invention will become apparent from the detailed description which follows.

SUMMARY OF THE INVENTION

The present invention provides apparatus and process for providing, and continuously monitoring and controlling, a tapered temperature profile in a solid metal object. The invention includes providing a metal object heated to a specified initial temperature, monitoring the temperature at a plurality of locations along the length of the heated metal, and adjusting the temperature of an adjoining portion of the heated metal by successively withdrawing and returning the adjoining portion to a heating source through physical movement of the solid metal. Successively withdrawing and returning the adjoining portion to the heating source reduces the heat in the adjoining portion relative to the hot end to form and maintain a specified tapered temperature profile.

In one aspect, the present invention provides apparatus and process for providing, and continuously monitoring and controlling, a tapered temperature profile in a billet of aluminum or aluminum alloy metal including rapidly heating in a single-zone electric induction furnace to a temperature sufficient to bring the billet to its cold end set point while not exceeding its maximum skin temperature. The invention provides for monitoring the temperature of the billet at its die end and its ram end, and adjusting temperature by successively withdrawing and returning the billet by physical movement relative to the induction furnace to reduce the heat in the ram end relative to the die end. The invention provides for establishing and maintaining a specified tapered temperature profile along the billet to match a desired temperature profile reference value. In one aspect, the tapered temperature profile of the present invention preferably produces a traveling crush or upset for reducing air entrapment in the extruded billet.

DETAILED DESCRIPTION

Figure 1:
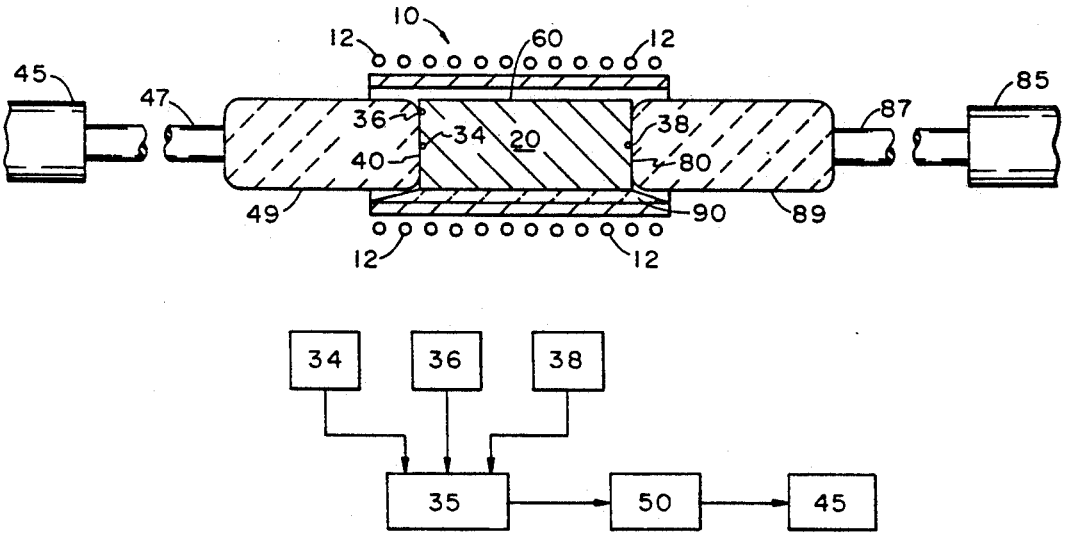
FIG. 1 depicts a diagrammatic side elevation view in partial section of an induction-heated temperature controller in accordance with the present invention.

The present invention provides apparatus and process for providing, and continuously monitoring and controlling, a tapered temperature profile in a solid metal object. A solid metal object, e.g., such as an aluminum billet, is heated to a specified initial temperature, and temperatures are monitored at a plurality of locations along the length of the heated metal. The temperature of an adjoining portion of the heated metal then is adjusted by successively withdrawing and returning the adjoining portion to a heating source through physical movement of the billet. Successively withdrawing and returning the adjoining portion to the heating source reduces the heat in the adjoining portion relative to the hot end to form and maintain a specified tapered temperature profile.

The apparatus and process of the present invention uses a heating source provided by a single zone electric induction furnace. The induction furnace heats the billet to a specified initial temperature sufficient to bring the metal to its cold end set point while not exceeding a maximum skin temperature. The maximum skin temperature is set to prevent melting of the metal during extrusion.

The present invention operates to extrude the metal, e.g., a billet of aluminum or aluminum alloy metal, while maintaining a specified tapered temperature profile from the hot end of the billet to the adjoining end of the billet of aluminum or aluminum alloy metal. The hot end is the die end, and the adjoining end is the ram end for extruding the billet of aluminum or aluminum alloy metal.

The temperature of the billet is monitored at a plurality of locations along its length. Monitoring is performed from sensor signals sent from a first thermocouple or series of thermocouples attached to the die end and from a second thermocouple or series of thermocouples attached to the ram end of billet of aluminum or aluminum alloy metal. The sensor signals are recorded over time, and a temperature profile is plotted to show the temperature change from the die end to the ram end of the billet.

The present invention further includes providing a comparison between (1) a reference value for a preferred temperature profile for a specific, predetermined alloy of aluminum versus (2) the actual temperature profile over the die end and the ram end of said billet of aluminum or aluminum alloy metal. The billet then is withdrawn or returned to the heating zone in the induction furnace in response to the comparison of the preferred temperature profile versus actual temperature profile. Withdrawing or returning the billet to the induction furnace in response to the comparison of preferred temperature profile versus actual temperature profile is performed by controllably moving the billet into and out of the induction furnace by servo-positioners.

Accordingly, the apparatus for providing, and monitoring and controlling, the tapered temperature profile in the solid metal includes means for heating a solid object, a first temperature sensing means on one end of the solid metal, a second temperature sensing means on an adjoining portion of the solid metal, means for comparing signals sent from the first and second temperature sensing means to form a temperature profile along the length of the solid metal, and means for controllably withdrawing and reinserting the solid metal by physical movement relative to the heating source to obtain and maintain the predetermined tapered temperature profile. The first and second temperature sensing means are provided by thermocouples attached to different ends of the solid metal, e.g., such as, different ends of a billet of aluminum or aluminum alloy. Preferably, a first thermocouple is positioned on the die end and a second thermocouple is positioned on the ram end of the billet of aluminum or aluminum alloy.

A computer is provided for comparing signals sent from the first and second temperature sensing means to form a temperature profile along the billet. The computer then is controllably linked to send command signals to the means for withdrawing and reinserting the billet relative to the induction heating source to obtain and maintain a predetermined tapered temperature profile.

The means for withdrawing and reinserting the billet relative to the induction heating source can be provided by a constant force cylinder loader applied to bias against the ram end and a servo-positioning cylinder biased to unload force against the die end. A replaceable ceramic cradle can be positioned within the induction furnace for sliding the billet and raising it to a coil centerline.

In one aspect, the present invention provides apparatus and process for establishing, and continuously monitoring and controlling, a tapered temperature profile in a billet of aluminum or aluminum alloy metal including a first procedure for rapidly heating the billet in a single-zone electric induction furnace to a temperature sufficient to bring the billet to its cold end set point while not exceeding its maximum skin temperature. The temperatures of the billet are monitored at its die end and its ram end, and the temperatures are adjusted by successively withdrawing and returning the billet by physical movement relative to the induction furnace to reduce the heat in the ram end relative to the die end. A specified tapered temperature profile is established and maintained along the billet to match a desired temperature profile reference value. In one aspect, the tapered temperature profile of the present invention preferably produces a traveling crush or upset for reducing air entrapment in the extruded billet.

The present invention provides for the detection and control in a metal billet of reductions or increases of the temperature profile along the length of the billet in a continuous manner.

The present invention measures and monitors temperature, determines temperature profile, and adjusts the localized heating and cooling to change the billet temperature profile in response to the temperature measuring and monitoring determination. The invention thereby provides a continuous monitor and control of the temperature profile of the aluminum billet. By measuring the magnitude of change of the temperature profile, the amount of inductive heating on the die end and the amount of conductive/convective cooling on the ram end can be quantified by reference to a specified standard for the desired tapered temperature profile.

Referring now to FIG. 1, an induction furnace 10 employs electromagnetic coils 12 for inducing a current through billet 20 thereby to increase billet temperature to a substantially uniform temperature, such as by way of one example, in the range of about 500° C. plus or minus 10%, but this is dependent on the aluminum alloy and its cold end set point while not exceeding its maximum skin temperature. Thermocouples 34, 36, and 38 measure the temperature of the aluminum billet 20. The thermocouple 34 measures the temperature at or near die end 40 of the aluminum billet 20. The die end thermocouple 34 also can be referred to as the hot end thermocouple. The thermocouple 36 measures the temperature at or near the periphery 60 of billet 20 to monitor skin temperature of the metal. The thermocouple 38 measures the temperature at or near ram end 80 of the aluminum billet 20. The ram end thermocouple 38 can also be referred to as the cold end thermocouple.

Temperature readings or sensor data measured and received from thermocouples 34, 36, and 38 are sent to data logger unit 35 as shown in this diagrammatical schematic of the apparatus and process of the present invention. Data from thermocouples 34, 36, and 38 are received and recorded by data logger unit 35. The collected data from data logger 35 then is sent to and correlated at computer 50.

Computer 50 analyzes the actual temperature profile determined from real time data, including comparing the temperature profile against a reference standard or predetermined temperature profile desired for the specific alloy used in the current extrusion operation. Computer 50 can present a plot of the temperature profile in the billet.

Computer 50 sends a signal or signals to servo-positioning cylinder 45 which extends or retracts through cylinder 47 to load or unload a biasing force through ceramic pusher 49 against billet 20 at ram end 40. Servo-positioning cylinder 45 controls the direction of billet 20 into or out of induction heater 10. A constant force cylinder 85 pushes with constant force through cylinder 87 through ceramic pusher 89 to load a biasing force on billet 20 at ram end 80. Constant force cylinder 85 through cylinder 87 and ceramic pusher 89 also functions as a loader for loading billet 20 into the induction heater 10. A ceramic cradle 90 raises the billet to a coil center line and reduces sliding friction of the billet into and out of induction heater 10.

Servo-positioning cylinder 45 and constant force cylinder 85 receive control information from computer 50 to control the average position and dither of billet 20 to produce and maintain a specified heat taper in the billet. Initially, the present invention calls for heating the billet to a substantially uniform reference temperature. Then, the billet 20 is withdrawn and cooled by ambient air or some other cooling mechanism, such as, by way of example, water mist. Ambient air cools the exposed end of the billet as it is withdrawn from induction heater 20. The operation of the present invention produces a cooling effect on the ram end 80 of the billet. The tapered temperature profile of billet 20 is thereby controlled by a computerized positioning of billet 20 as it is withdrawn and reinserted into induction heater 10.

Figure 2:
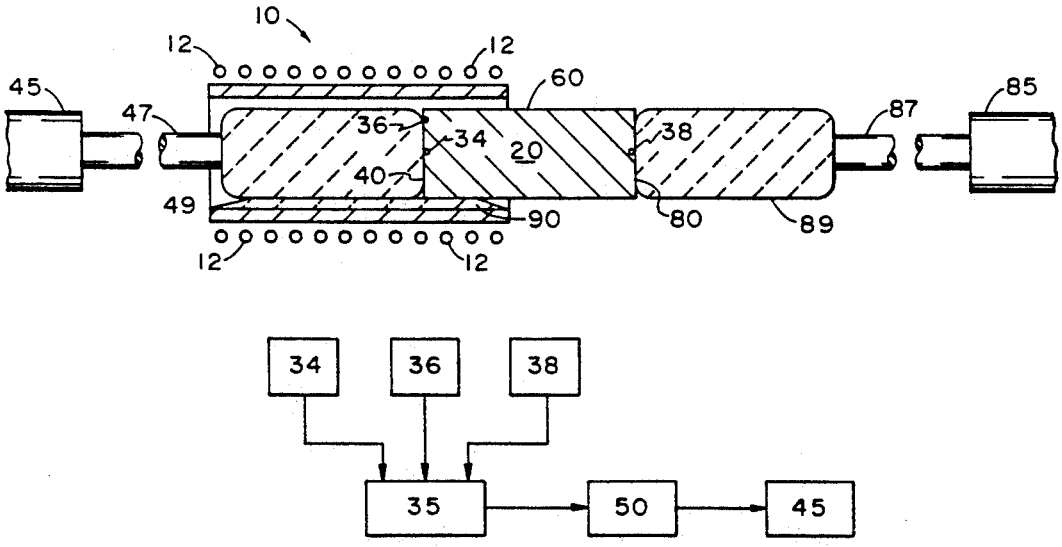
FIG. 2 shows a diagrammatic side elevation view in partial section of an induction-heated temperature controller in accordance with the present invention with the billet withdrawn.

FIG. 2 shows a schematic in accordance with the present invention with the billet 20 withdrawn from induction heater 10. Variations in the predetermined, initial set temperature profile are monitored by thermocouples 34, 36, 38 which can be provided by embedded spear point thermocouples embedded in the ceramic pushers to contact the aluminum at the proximate location the desired temperature sensing data is desired to be obtained.

Figure 3:
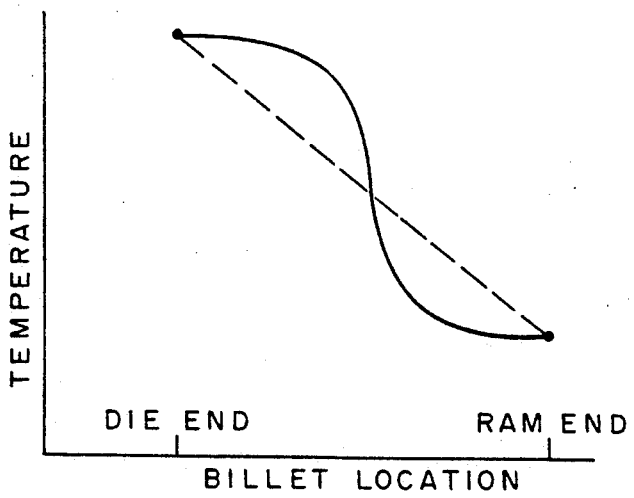
FIG. 3 presents a graphical depiction of a temperature profile as established and controlled by the present invention applied to a billet of aluminum or aluminum alloy.

A plot of temperature profile by computer 50 can provide a graphical analysis as shown in FIG. 3. A plot of actual temperature profile versus a specified reference temperature profile can be viewed for the billet in real time. The comparison is provided by plotting the actual temperature profile versus a predetermined, set temperature. The desired difference then is calculated and analyzed by computer 50 in such a way to adjust the movement of billet 20 into or out of induction heater 10 in response to the computer 50 comparison and analyses of data received from data logger 35, as discussed in relation to FIG. 4.

Figure 4:
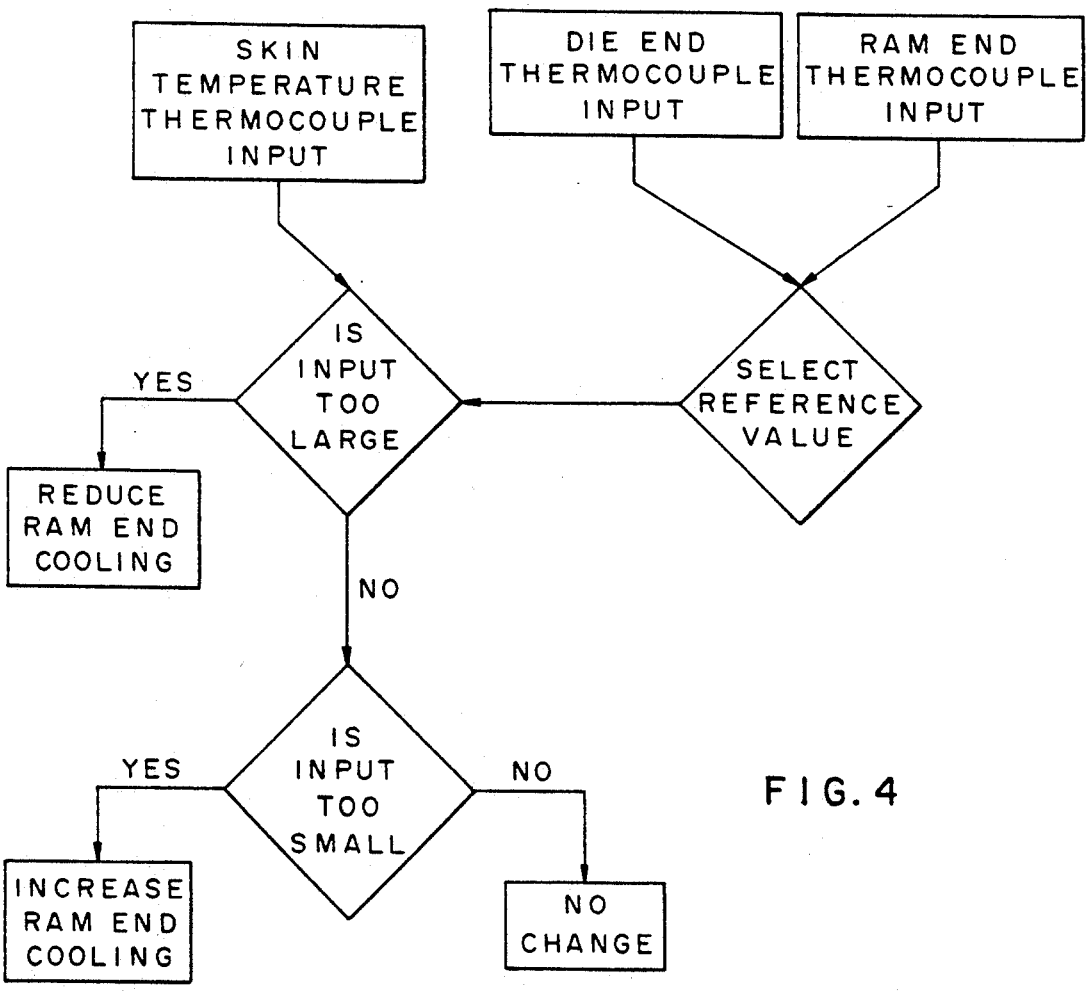
FIG. 4 depicts a logic and process flow diagram showing decisions of the process in controlling the temperature profile in a billet of aluminum or aluminum alloy in accordance with the present invention.

FIG. 4 presents a logic and process flow diagram showing decisions of the process for controlling the temperature profile of the aluminum billet in accordance with the present invention. Essentially, the procedure followed in the process includes the steps of inputting the sensor signals from the two thermocouples 34 and 38 at the die end 40 and ram end 80, respectively, into the microprocessor, comparing the sensor signals and determining if the difference is larger than the reference value stored in the microprocessor, while factoring in the temperature value coming in from the skin temperature thermocouple 36 positioned at the periphery location 60 of the billet. If the comparison is larger than the reference signal, a command signal is sent to servo-positioning cylinder 49 as shown in FIGS. 1 and 2. If the comparison is not larger than the reference signal, the microprocessor determines if the comparison is smaller than the reference value, and if so, a command signal is sent to the servo-positioning cylinder 49 to reinsert billet 20 into induction heater 10. If the input signal is not smaller than the reference signal, no command signal is sent to servo-positioning cylinder 49.

Uniformly heated billets extruded by high speed by conventional presses are seen to have temperatures of the product emerging from the die equal to the billet temperatures only at the beginning of the extrusion process. As the extrusion process proceeds, temperatures rise by an amount proportional to the work done in the deformation zone of the metal being extruded. The temperature continues to rise as metal entering the deformation zone has a higher temperature because of shear stresses along the bore of the billet prior to extrusion through the die. The kinetic energy required in the extrusion converts to heat and flows into the billet, the die, and billet container.

Reducing the temperature of the rear part of the billet is seen to permit higher extrusion speeds and lower extrusion pressures, because of a reduction in temperature of the billet. Aluminum forming by extrusion can employ billets preheated to a tapering billet temperature so that the die end is hotter than the ram end. The tapered preheat temperature can cause a traveling upset that reduces air entrapment in the aluminum product. However, conventional furnaces and processes are difficult to set up for a new taper and are poor at maintaining a taper during manufacturing delays.

It has been found that conventional induction furnace heating produces a curve or a knee in aluminum billets, rather than a true linear tapered temperature profile. It is believed the reason for the undesirable curve or knee is because of the high thermal conductivity of the aluminum, which is seven times higher than steel, for example. Conventional processes produce only a preheated billet that is softer than is desired at the front end and harder than is desired at the back, or ram end.

The apparatus and process of the present invention, on the other hand, provide a tapered temperature profile in an aluminum billet to establish and maintain a true linear taper, to match the preferred specified tapered temperature profile as shown in FIG. 3.

The apparatus and process of the present invention preferably produce a specified tapered temperature profile to produce a traveling crush caused by a temperature gradient in the billet, so that the billet crushes on the front end before the rear end. The traveling crush reduces and prevents air entrapment for the extrusion process.

The apparatus and process of the present invention provide for maintaining a billet at a heated condition for a period until it is called for to be used in the extrusion process. Prior practices would produce billets which either lost their temperature profile by cooling or which would be required to be held in the induction heater and increase temperature too high for extrusion by reason of exceeding a maximum specified skin temperature.

The apparatus and process of the present invention also provide the advantage of using a high powered, uniform induction heating for a rapid heat-up of the billet. Prior practices use selective power and split coils in the induction heater. The intentionally low power in the selective power induction heater results in slower heat-up of the billet.

The apparatus and process of the present invention provide the advantage of a programmable preheat process to bring the billet to the specified tapered temperature profile desired for the extrusion process. Monitoring of both the center and the skin temperature, as required in the present invention, provides for a rapid heat-up without skin melt.

The controlled ambient air cooling of the cold end, or ram end, provides for an indefinite period in which the tapered temperature profile in the billet can be maintained, i.e., as long as required by the overall extrusion process or shop schedule.

The present invention provides a real-time sensor for measuring and monitoring temperature of the metal billet and then determining the temperature profile of the billet. The invention provides for monitoring and controlling the temperature profile of a billet of aluminum or aluminum alloy including rapidly heating a billet to a cold end set point while not exceeding a maximum skin temperature in a low cost production furnace and then matching a specified tapered temperature profile, thus to provide for the production of quality aluminum extrusions at efficient production rates.

The apparatus and method of the present invention are not limited to the descriptions of specific embodiments hereinabove, but rather the apparatus and method of the present invention should be viewed in terms of the claims that follow and equivalents thereof.

What is claimed is:

1. A method for providing a tapered temperature profile in a metal billet prior to extrusion, comprising:

(a) providing a metal billet heated to a specified substantially uniform initial temperature;

(b) monitoring the temperature of said heated metal billet at a plurality of locations along the length of said heated metal billet; and (c) successively withdrawing and returning said metal billet to a heating source through physical movement of said metal billet in response to said monitoring said temperature to reduce the heat in an adjoining portion relative to the hot end of said metal billet to form and maintain a specified tapered temperature profile along said metal billet.

2. A method as set forth in claim 1, wherein said heating source comprises a single zone electric induction furnace.

3. A method as set forth in claim 2, wherein said specified substantially uniform initial temperature comprises a temperature sufficient to bring said metal billet to its cold end set point while not exceeding a maximum skin temperature.

4. A method as set forth in claim 3, wherein said monitoring the temperature of said heated metal billet further comprises monitoring both the center and the skin temperature of a heated metal billet of aluminum or aluminum alloy metal.

5. A method as set forth in claim 4, further comprising (d) extruding said billet having said specified tapered temperature profile over said hot end and said adjoining end of said billet of aluminum or aluminum alloy metal.

6. A method as set forth in claim 5, wherein said hot end comprises the die end and said adjoining end comprises the ram end for extruding said billet of aluminum or aluminum alloy metal.

7. A method as set forth in claim 6, wherein said monitoring the temperature of said heated metal billet at a plurality of locations along the length of said heated metal billet further comprises monitoring sensor signals sent from a thermocouple attached to said die end and from a thermocouple attached to said ram end of said billet of aluminum or aluminum alloy metal.

8. A method as set forth in claim 7, further comprising recording said sensor signals over time and plotting a temperature profile over said die end and said ram end of said billet of aluminum or aluminum alloy metal.

9. A method as set forth in claim 8, further comprising providing a comparison of (1) a reference value for a preferred temperature profile for a specific, predetermined alloy of aluminum versus (2) the actual temperature profile over said die end and said ram end of said billet of aluminum or aluminum alloy metal.

10. A method as set forth in claim 9, comprising withdrawing or returning said billet to said induction furnace in response to the comparison of preferred temperature profile versus actual temperature profile.

11. A method as set forth in claim 10, wherein said withdrawing or returning said billet into said induction furnace in response to the comparison of preferred temperature profile versus actual temperature profile comprises controllably moving said billet into and out of said induction furnace by servo-positioners.

12. Apparatus for providing a tapered temperature profile in a metal billet comprising:

(a) means for heating a metal billet;

(b) a first temperature sensing means on one end of said metal billet;

(c) a second temperature sensing means on an adjoining portion of said metal billet;

(d) means for comparing signals sent from said first and second temperature sensing means to form a temperature profile along said metal billet; and (e) means for controllably withdrawing and reinserting said metal billet by physical movement relative to a heating source to obtain and maintain a predetermined tapered temperature profile.

13. Apparatus as set forth in claim 12, wherein said means for heating said metal billet comprises a single zone electric induction furnace.

14. Apparatus as set forth in claim 13, wherein said first and second temperature sensing means comprises thermocouples attached to different ends of said metal billet.

15. Apparatus as set forth in claim 14, further comprising means for monitoring both the center and the skin temperature of a billet of aluminum or aluminum alloy.

16. Apparatus as set forth in claim 15, wherein said first thermocouple is positioned on the die end and said second thermocouple is positioned on the ram end of said billet of aluminum or aluminum alloy.

17. Apparatus as set forth in claim 16, wherein said means for comparing signals sent from said first and second temperature sensing means to form a temperature profile along said metal billet is controllably linked to send command signals to said means for withdrawing and reinserting said metal billet relative to a heating source to obtain and maintain said predetermined tapered temperature profile.

18. Apparatus as set forth in claim 17, wherein said means for withdrawing and reinserting said metal billet relative to a heating source to obtain and maintain said predetermined tapered temperature profile comprises a constant force cylinder loader applied to bias against the ram end and a servo-positioning cylinder biased to unload force against said die end.

19. Apparatus as set forth in claim 18, wherein said means for withdrawing and reinserting said metal billet relative to a heating source to obtain and maintain said predetermined tapered temperature profile further comprises a replaceable ceramic cradle positioned within said induction furnace for raising said billet to a coil centerline.

20. A method for providing a tapered temperature profile in a billet of aluminum or aluminum alloy metal comprising:

(a) providing a billet of aluminum or aluminum alloy metal rapidly heated in a single zone electric induction furnace to a temperature sufficient to bring said billet to its cold end set point while not exceeding its maximum skin temperature;

(b) monitoring the temperature of said billet at its die end and its ram end; and (c) successively withdrawing and returning the ram end by physical movement relative to said induction furnace to reduce the heat in said ram end relative to said die end in response to said monitoring said temperature to form and maintain a specified tapered temperature profile along said billet, thereby producing a traveling crush or upset for reducing air entrapment in the extruded billet; and (d) extruding said billet.

* * * * *